US010422267B2

(12) United States Patent
Quinby

(10) Patent No.: US 10,422,267 B2
(45) Date of Patent: Sep. 24, 2019

(54) MARINE RUDDER EXHAUST SYSTEM

(71) Applicant: Benjamin Quinby, Boise, ID (US)

(72) Inventor: Benjamin Quinby, Boise, ID (US)

( * ) Notice: Subject to any disclaimer, the term of this patent is extended or adjusted under 35 U.S.C. 154(b) by 0 days.

(21) Appl. No.: 15/815,631

(22) Filed: Nov. 16, 2017

(65) Prior Publication Data

US 2018/0328255 A1 Nov. 15, 2018

Related U.S. Application Data

(60) Provisional application No. 62/422,955, filed on Nov. 16, 2016.

(51) Int. Cl.

| | |
|---|---|
| ***B63H 21/32*** | (2006.01) |
| ***F01N 13/12*** | (2010.01) |
| ***B63B 9/00*** | (2006.01) |
| ***F01N 13/00*** | (2010.01) |
| *B63H 20/24* | (2006.01) |

(52) U.S. Cl.

CPC ..... *F01N 13/12* (2013.01); *B63B 9/00* (2013.01); *B63H 21/32* (2013.01); *F01N 13/004* (2013.01); *B63H 20/245* (2013.01); *F01N 2590/02* (2013.01)

(58) Field of Classification Search

CPC ..... B63B 2001/385; B63H 20/245; B63H 20/26; B63H 21/32; B63H 21/34; F01N 13/12; F01N 2590/02; F01N 2590/021; F01N 2590/022

See application file for complete search history.

(56) References Cited

U.S. PATENT DOCUMENTS

| | | | | |
|---|---|---|---|---|
| 3,659,547 | A | 5/1972 | Stuart | |
| 5,326,294 | A | 7/1994 | Schoell | |
| 5,700,172 | A | 12/1997 | Ousley, II et al. | |
| 5,863,231 | A | 1/1999 | Strong | |
| 6,042,437 | A | 3/2000 | Widmann et al. | |
| 6,705,907 | B1 | 3/2004 | Hedlund | |
| 7,387,555 | B1 | 6/2008 | Mann | |
| 7,806,064 | B2 * | 10/2010 | Wellman | B63B 1/38 114/67 R |
| 9,242,700 | B1 | 1/2016 | Viviani et al. | |
| 2010/0041288 | A1 | 2/2010 | Woods et al. | |

FOREIGN PATENT DOCUMENTS

EP 909703 A2 * 10/1998

OTHER PUBLICATIONS

Mann, Larry; FAE—Fresh Air Exhaust Spec Sheet.

* cited by examiner

*Primary Examiner* — Andrew Polay

(57) ABSTRACT

The present disclosure is directed toward a marine exhaust system in which the marine exhaust is directed into the water via an exhaust system integrated within a marine rudder. Exhaust travels from the engine to the rudder via a pipe or tube and is expelled through a cavity in the rudder outward into the water. A swivel is located in the system to allow the rudder to rotate in normal steering operations to allow at least a portion of the exhaust pipe or tube to remain static.

6 Claims, 4 Drawing Sheets

MARINE RUDDER EXHAUST SYSTEM

This application claims the benefit of U.S. Provisional Application No. 62/422,955 filed Nov. 16, 2016, the disclosure of which is incorporated by reference.

TECHNICAL FIELD

The disclosure generally relates to the field of boat exhausts and rudders. Particular embodiments relate to an integrated exhaust and rudder system.

BACKGROUND OF THE INVENTION

At least one device exists in the field of exhaust dispersion systems for ski, wake, surf, and recreational boats and other boats having inboard motors and/or outboard motors with independent rudders. When a surf boat is operating on the water, the surf boat motor typically utilizes an internal combustion engine in order to propel the surf boat. The gas powered engine generates exhaust which typically includes carbon monoxide and other harmful and/or offensive gases, as well as particulate exhaust. While surfing, the user of the surf boat typically does not want to be positioned in a fume of exhaust being admitted from the engine, but wave propagation occurs directly behind the boat; the surfer will surf on one side of the wave which puts the surfer directly in the stream of the engine exhaust path. Accordingly, several devices have been developed to direct the emissions of the gas into the water on which the ski boat is being utilized. Typically these devices utilize an exhaust tube that is directed under the boat where the gases are dispelled into the propulsion stream emitted by the propeller or jet of a surf boat.

Boats utilized for water skiing, wakeboarding, tubing, surfing and/or the towing of people engaging in other miscellaneous watersports typically utilize large engines that can propel the boat at a high velocity or high loads such as when operating with large amounts of ballast. In order to create a desirable wake effect in the water behind the boat, the ballast(s) of the boat are often filled with water to an extent in order to cause the boat to rest or propel at a lower position in the water with increased displacement. In order to propel the boat while the ballast(s) is filled or partially filled, a larger engine is required to propel the boat. A larger engine in turn generates more exhaust when utilized to propel the boat at wakeboarding or surfing speeds that are sufficient to produce a desirable wake effect in the water as well as to pull the wake-boarder behind the boat at a sufficient speed, or to create a surf wake capable of propelling the surfer directly behind the boat.

In order to dispel the exhaust into the water and away from the user of the surf boat and away from the water-skier or wake boarder being towed behind the boat, or surfer riding the wave behind the boat, several devices have been created to expel the exhaust into the water. However, due to the large amount of exhaust produced by the water-ski boat, large pipes are often required that extend outward from the stern of the boat. These pipes can interfere with a wake boarder or water skier entering or exiting the water and interfere with the wake of the boat while in motion. Accordingly, what is needed is a more aesthetic, less obtrusive mechanism to dispel motor exhaust from a boat.

SUMMARY OF THE DISCLOSURE

The purpose of the summary is to enable the public, and especially the scientists, engineers, and practitioners in the art who are not familiar with patent or legal terms or phraseology, to determine quickly from a cursory inspection, the nature and essence of the technical disclosure of the application. The summary is neither intended to define the inventive concept(s) or the application, which is measured by the claims, nor is it intended to be limiting as to the scope of the inventive concept(s) in any way.

The disclosed inventive concept pertains to a rudder for a boat or other marine vessel having a passageway therein configured for dispelling exhaust produced by an engine or motor. Also disclosed is a method of retrofitting a boat to utilize a rudder having an integrated exhaust passageway. Further disclosed is a boat having a rudder having an integral exhaust passageway that is for dispelling of gaseous exhaust from the motor of the boat. The method of retrofitting a boat involves removing the external exhaust hardware, including but limited to exhaust pipes or removing an existing rudder if there is one, attaching a rudder having a passageway configured for the dispelling of gaseous exhaust through the rudder, connecting the rudder having a passageway for dispelling gas to the boat, and attaching a pipe and/or tube from the motor of the boat to the rudder. This method can include providing a swivel connection between the boat motor and the rudder having a passageway for dispelling gaseous exhaust. Alternatively, there can be a separate swivel located between the rudder and the boat motor such that when the rudder is moved by the steering mechanism of the boat the swivel allows for the independent movement of the rudder without twisting or damaging the exhaust pipe or tube between the motor and the rudder. This will allow the rudder to move independently without moving the pipe or tube within the motor and the rudder, or with only moving a limited portion of the rudder or tube, or alternatively, the entire tube or pipe can move with the rudder if the swivel is adjacent to the motor.

The exhaust passageway is connected to an exhaust pipe or tube from the motor via a swivel integral in the connection or independent of said connection. In a preferred embodiment, the outlet for output opening for the rudder is located on a trailing edge of the rudder. In a further preferred embodiment, the rudder is an outboard rudder. In a further preferred embodiment the swivel is connected to the exhaust connection connecting a boat exhaust hose to the rudder body such that gaseous exhaust passes from the boat exhaust hose through the passageway. The rudder is generally utilized for the steering of the boat such that the rudder turns in connection with the steering mechanism such as but limited to a steering wheel located on the boat.

The passageway through the rudder can be in a wide variety of shapers or sizes, sufficient to allow for the dispelling of gaseous exhaust from the motor of the boat. It is thought that providing an integral exhaust and rudder will obviate the need for having any independent exhaust pipes or tubes and thus, promote a clean look on the boat, amongst other possible benefits.

DETAILED DESCRIPTION OF THE DRAWINGS

Figure 1:
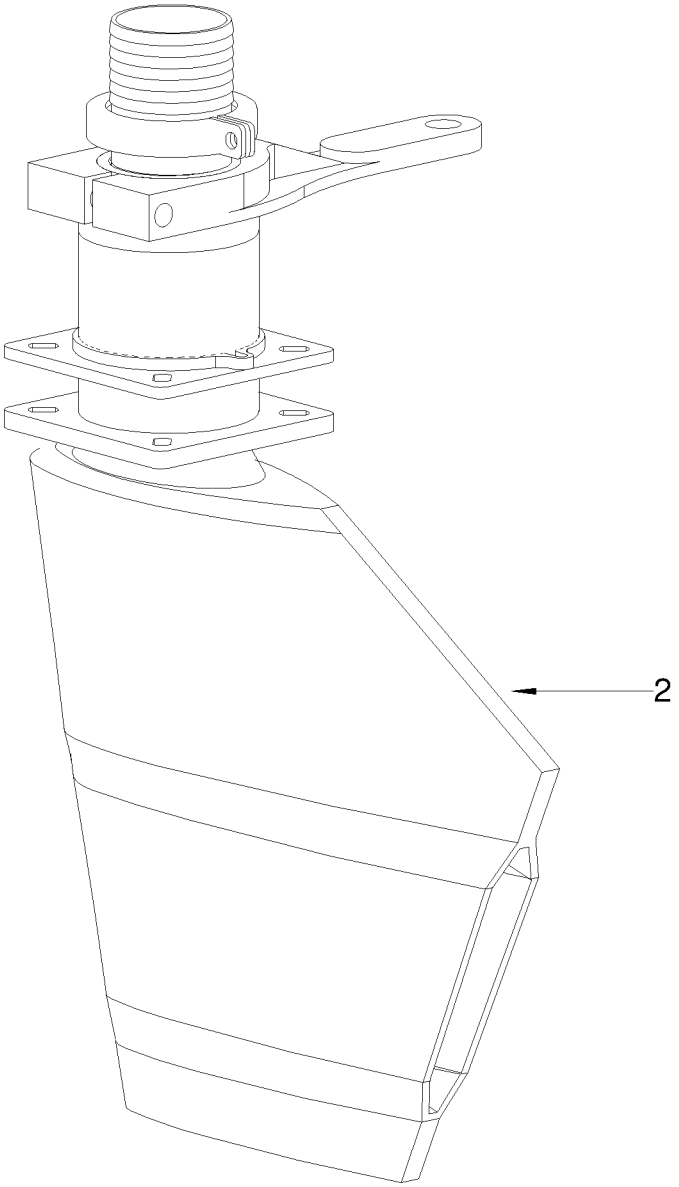
FIG. 1 is a perspective view of a rudder exhaust system.
Figure 2:
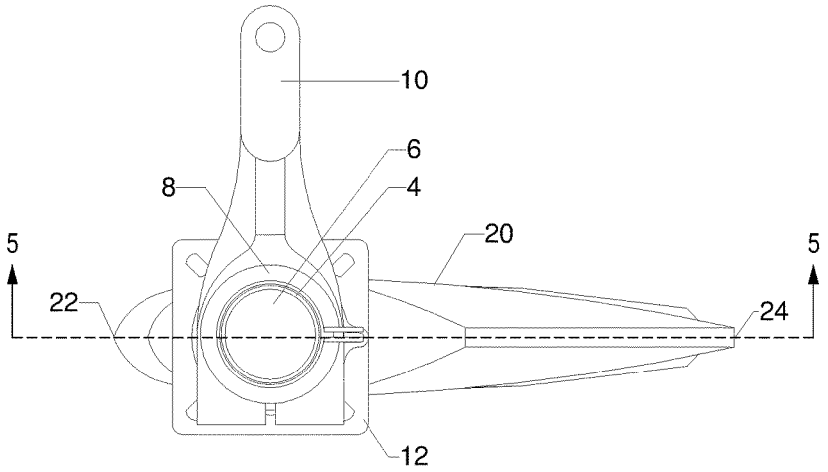
FIG. 2 is a top view of a rudder exhaust system.
Figure 3:
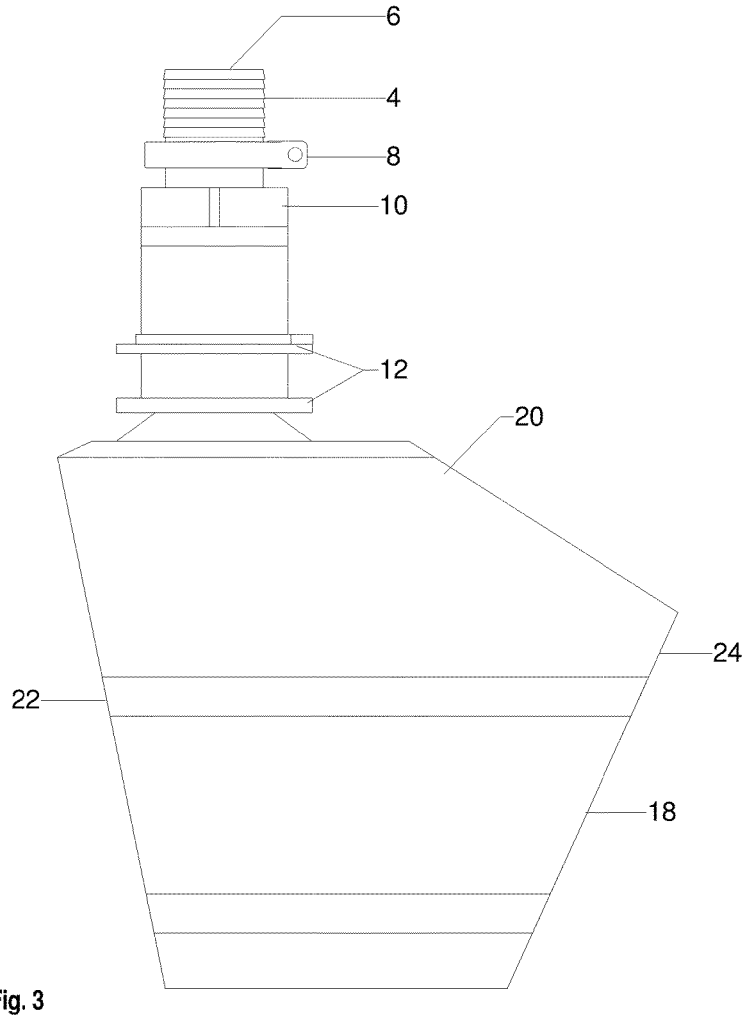
FIG. 3 is a side view of a rudder exhaust system.
Figure 4:
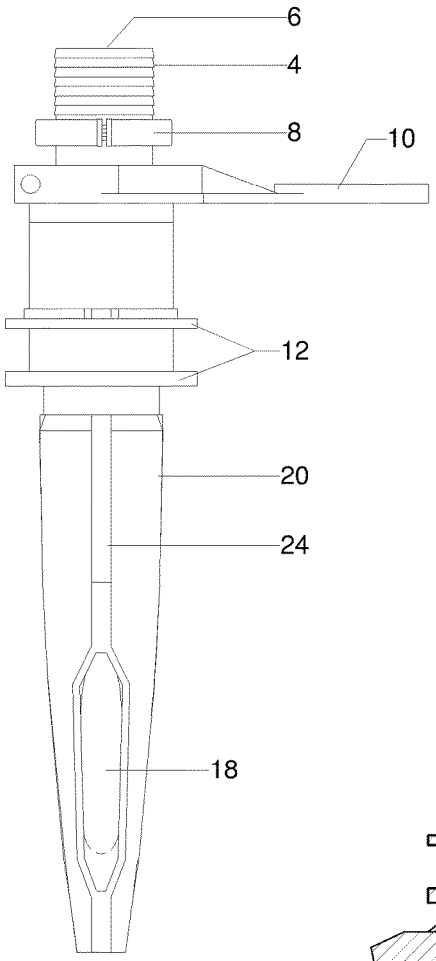
FIG. 4 is a rear view of a rudder exhaust system.
Figure 5:
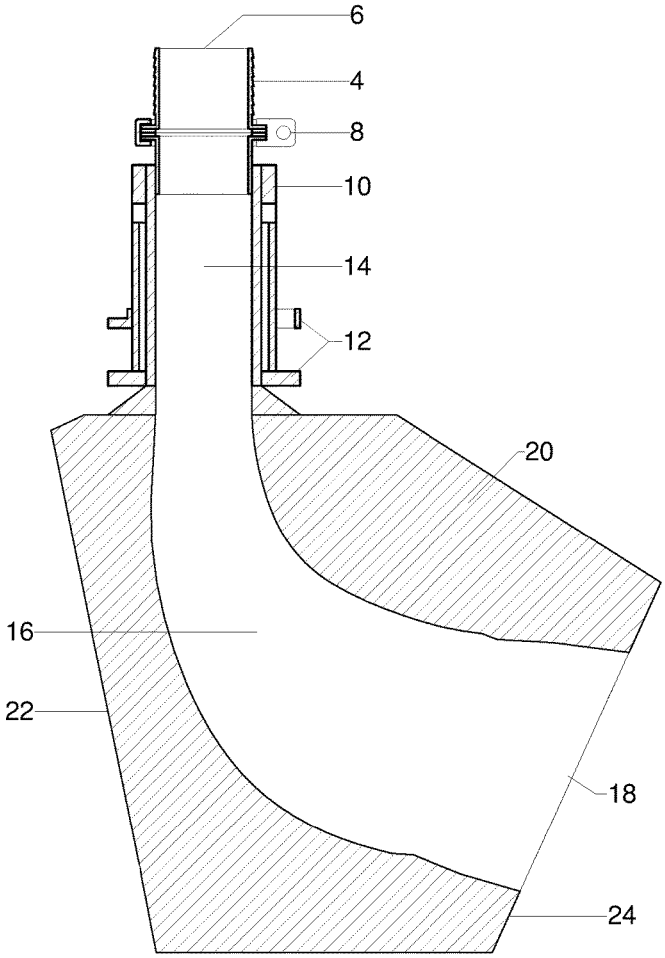
FIG. 5 is a side view of a dissection of embodiment depicted in FIG. 1.
Figure 6:
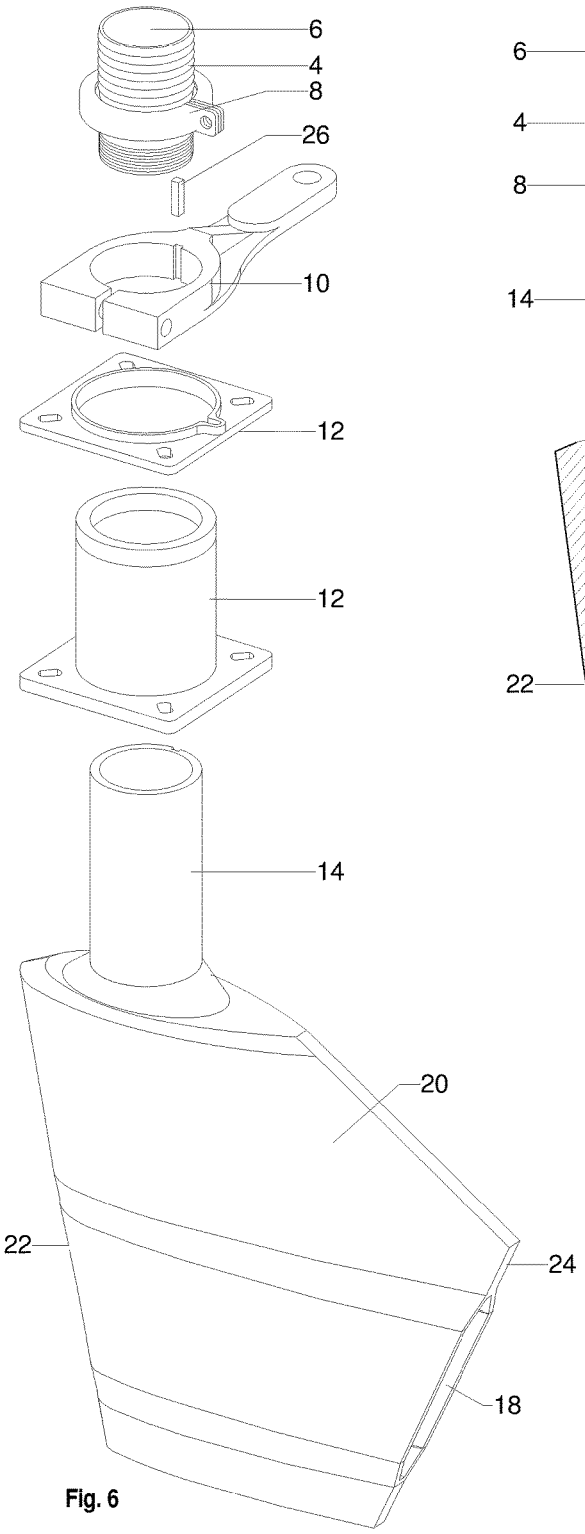
FIG. 6 is an exploded perspective view of an embodiment of a rudder exhaust system.
Figure 7:
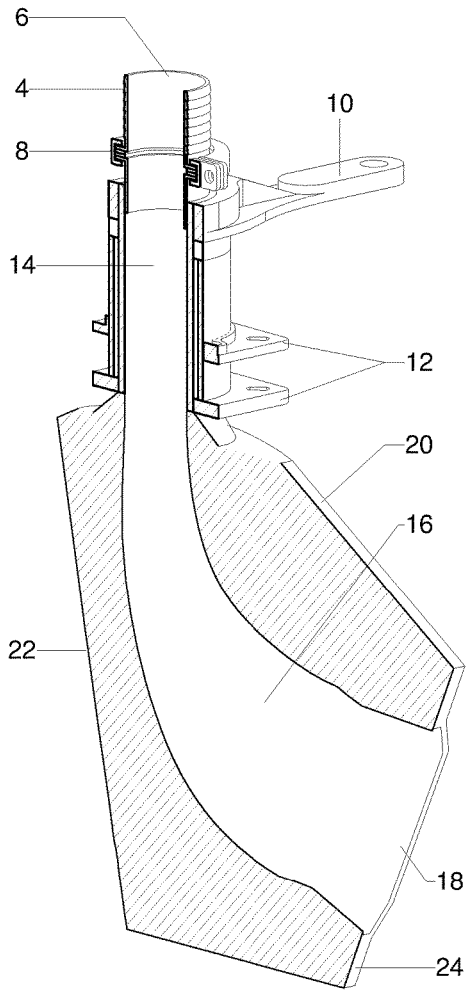
FIG. 7 is a perspective view of a rudder exhaust system cross sectional along the line 5 of FIG. 2.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined herein.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

FIG. 1 illustrates a perspective view of a rudder with an integrated exhaust cavity and exhaust exit portal. The rudder exhaust system of the invention includes a rudder having an integrated exhaust that is coupled via an exhaust hose to an inboard motor. The rudder exhaust system includes an attachment point for an exhaust hose that is in connection with the exhaust port of an inboard motor. Exhaust travels from an exhaust manifold, pipe, and/or hose (not shown) attaching at point 4. Exhaust travels from the motor to the rudder exhaust system at which point the exhaust enters into the rudder exhaust system via opening 6. The rudder rotates in order to direct the travel direction of the boat.

A swivel 8 allows the rudder to swivel while allowing the exhaust hose between the motor and the rudder to remain in a generally static position. In a preferred embodiment the rudder exhaust system includes an integrated tiller arm 10. The tiller arm allows for either manual or automatic steerage of the rudder. The steerage can include, for example, a console steering system including a steering wheel, or a computer controlled steering system.

The rudder exhaust system has a rudder body 20 attached to the steering the tiller arm and swivel via rudder box assembly 12. The rudder body 20 includes a leading edge 22 and a trailing edge 24. The rudder body has a cavity or void 16. Exhaust travels into the rudder cavity via opening 6 and travels through the cavity or void 14 in the rudder shaft. The exhaust then travels into the cavity or void 16 in the rudder body that is expelled at exit point or portal 18.

The exhaust exit point is located in the trailing edge of the rudder in a preferred embodiment although in alternate embodiments the exit point could be located on either side of the rudder or in any edge of the rudder. In a preferred embodiment the exit point is located in the trailing edge of the rudder in order to propel the exhaust into the water in the opposite direction in which the boat is traveling. This allows the exhaust to essentially to be steered into the trailing wake of the boat. By integrating the exhaust portal and exhaust system with the rudder this allows for a decrease in the amount of hardware and/or pipes located on or around the transom or stern of a boat.

While in one embodiment the rudder exhaust system is utilized on a inboard rudder, the rudder exhaust system is also thought to be applicable to an outboard rudder system in which the rudder is located aft of the boat. The exhaust system can be utilized with a variety of motor types. These motor types preferentially thought to be inboard motors, however it is conceivable that the invention could be utilized with an outboard motor in which the outboard motor is separate from the rudder system.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

What is claimed is:

1. A method of installing a rudder on a marine vessel, said method comprising the following steps:

the step of providing a rudder body configured for the steering of a boat, said rudder body comprising a passageway for dispelling of gaseous exhaust having an input opening and an output opening, wherein said output opening is located on a trailing edge of said rudder;

the step of attaching said rudder to a boat;

the step of providing a connection between said rudder and a motor of said boat such that exhaust generated by said motor passes from said motor to said rudder and through said passageway through said rudder, wherein said connection comprises a swivel such that said rudder is configured to move in response to a user input for steering said boat, wherein said rudder is configured to move independently of said motor via said swivel.

2. The method of claim 1, wherein said method comprises a method of retrofitting a boat with a rudder, wherein said rudder comprises a passageway through said rudder configured for the passage of gaseous exhaust from a boat motor.

3. A rudder exhaust system for controlling gaseous emissions from a boat engine, said system comprising:

a rudder body configured for the steering of a boat, said rudder body comprising a passageway for dispelling of gaseous exhaust having an input opening and an output opening, wherein said output opening is located on a trailing edge of said rudder;

an exhaust connection for connecting a boat exhaust hose to said rudder body such that gaseous exhaust passes from a boat exhaust hose into said passageway;

an exhaust hose attached to said exhaust connection; and a swivel located to allow rotation of said rudder body while allowing said exhaust hose to remain static.

4. The exhaust system of claim 3, wherein said rudder comprises an outboard rudder.

5. The exhaust system of claim 3, wherein said swivel is connected to said exhaust connection.

6. The exhaust system of claim 3, wherein said swivel is positioned such as to be between two sections of said exhaust hose, pipe, or a combination thereof.

* * * * *